US005575016A

United States Patent [19]

Bailey

[11] Patent Number: 5,575,016

[45] Date of Patent: Nov. 19, 1996

[54] KILTIE WEIGHT

[76] Inventor: James J. Bailey, 100 Watkins Rd., Sherman, Tex. 75090

[21] Appl. No.: 577,902

[22] Filed: Dec. 22, 1995

[51] Int. Cl.[6] ..... A43B 5/00

[52] U.S. Cl. ..... 2/245; 36/132

[58] Field of Search ..... 2/245–255, 256, 2/258, 259, 273; 36/127, 130, 132, 136

[56] References Cited

U.S. PATENT DOCUMENTS 5,209,000 5/1993 Rowland et al. ..... 2/245

*Primary Examiner*—C. D. Crowder
*Assistant Examiner*—Gloria Hale
*Attorney, Agent, or Firm*—Jerry C. Ray

[57] ABSTRACT

A weight for kilties on boots and shoes is a thin strip of pliable metal with a serrated edge for attaching to the forward edge of the kiltie on the underside, where it weighs the kiltie to prevent curling and may be bent to conform to the shape of the shoe upper. Attachment to the kiltie is by a coating of adhesive covered by a peelable backing. A liner of leather or fabric or a coating of other material on the lower surface of the weight prevents discoloration of the shoe vamp by contact with the metal.

14 Claims, 2 Drawing Sheets

Fig. 3
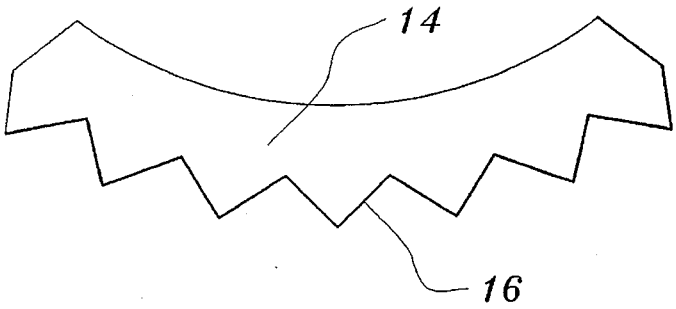
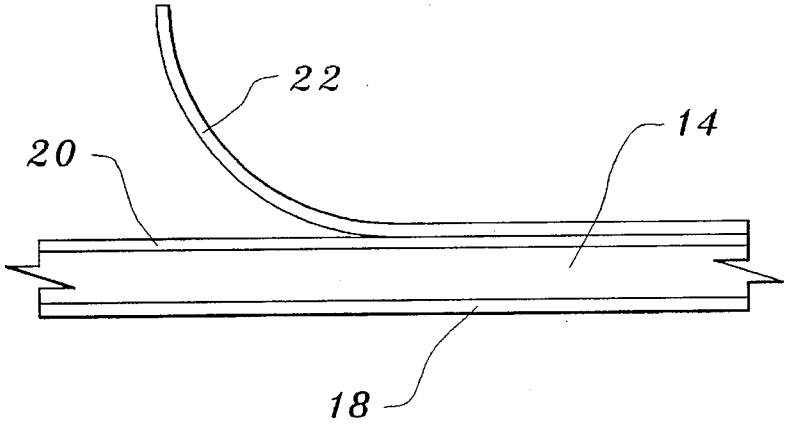
Fig. 4
Fig. 5
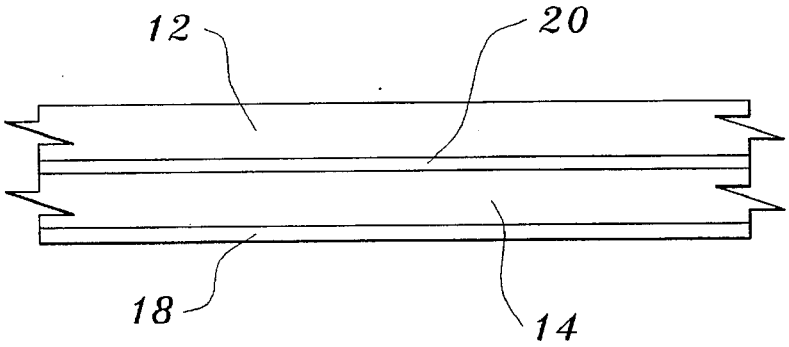

KILTIE WEIGHT

BACKGROUND OF THE INVENTION

1. Field of the Invention

This invention relates to devices for maintaining the shape and position of kilties on boots and shoes, and specifically to weights which attach on the underside of kilties and conform to the shape of the kiltie.

2. Description of the Related Art

A kiltie is a long slashed tongue on a boot or shoe which either covers the lacing or extends from beneath the lacing over the vamp or upper part of the boot. The front end of a kiltie is generally serrated or scalloped. Sometimes "kiltie" is used to refer to the entire shoe or boot having such a slashed tongue, but as used herein refers only to the tongue itself.

Kilties are generally made of leather; the problem to be solved is maintaining the shape of the kiltie, and especially preventing the front end of the kiltie from curling up and becoming unsightly. This problem is greatest where kilties are used on boots; a type of boot currently popular has a kiltie extending from beneath the laces forward over the vamp or upper of the boot. The toe of boots (or shoes) is bent upward during walking, so the kilties have a tendency to be pushed upward, away from the upper of the shoe. Because the boots are worn for working, they are exposed to repeated wetting and drying, making the curling problem more severe.

In the related art, the following patents are known to Applicant, here listed for consideration by the Examiner:

| Patent Number | Issue Date | Patentee |
|---|---|---|
| 1,974,721 | Sep. 25, 1934 | Miller |
| 2,022,544 | Nov. 26, 1935 | Williams |
| 3,601,909 | Aug. 31, 1971 | Amendola |
| 4,805,321 | Feb. 21, 1989 | Tonkel |

Amendola discloses a metal insert contained in a pocket on the underside of a kiltie; the pocket is at the mid-section of the kiltie, and the metal is bent into shape to maintain the curvature of the kiltie. Williams discloses a kiltie with a snap fastener to hold it down, and has a strip of metal similar to that of Amendola, for maintaining the curvature of the portion of the kiltie above the instep. Miller also discloses a strip of metal sewn into a pocket on a kiltie, to maintain the transverse curvature of the kiltie. None of these inventions, however, address the problem of preventing curling at the end of a kiltie, nor do they provide means for maintaining the shape of a kiltie which may be easily attached by the consumer after the boots are purchased.

SUMMARY OF THE INVENTION

The invention provides a weight for attaching to kilties on boots and shoes to prevent the kiltie end from curling upward due to exposure to weather or from aging. Made from a strip of malleable metal or other material, the weight attaches under the serrated edge of the kiltie; the forward edge of the weight is serrated to match the kiltie edge. The kiltie weight may be incorporated in to the manufacturing process; i.e., the weight may be attached to leather, after which both leather and weight are stamped into the desired shape. Cutting leather and weight on the same die would leave the edges of the kiltie leather and the weight aligned, so the edge of the weight would be visible. It is anticipated that the weight will be added in a separate step after the kiltie is cut to shape, with the edge of the weight set back slightly from the edge of the kiltie, so that the weight is completely hidden. Alternatively, the weight is designed to be an after-market attachment, and is attached to the kiltie by a layer of adhesive protected by a peelable backing. A liner or a coating of material on the lower surface of the weighted strip prevents discoloration of the shoe leather where it contacts the strip. In addition to providing a weight to hold down the end of the kiltie, the metal strip may be bent to hold the end of the kiltie in a desired curvature.

Given the above, it is an object of this invention to provide a weight which may be attached to kilties either during manufacturing or by the consumer, and which will prevent curling and deformation of the kiltie edge.

It is a further object to provide a kiltie weight having a serrated edged, which may be attached to the underside of the leading edge of a kiltie.

It is another object to provide a kiltie weight which will be hidden from view when installed.

Other objects are to accomplish the above with devices that are sturdy, compact, durable, lightweight, simple, safe, efficient, and reliable, yet inexpensive and easy to manufacture and install.

The specific nature of the invention, as well as other objects, uses, and advantages thereof, will clearly appear from the following description and from the accompanying drawings, the different views of which are not necessarily scale drawings.

BRIEF DESCRIPTION OF THE DRAWINGS

FIG. 3 is a top plan view of the kiltie weight with serrated edge.

FIG. 4 is a front elevation showing a kiltie weight with adhesive and a peelable backing on its upper surface and a leather lining on its lower surface.

FIG. 5 is a front elevation showing, from top down: a kiltie, adhesive, weight, and lining.

CATALOG OF THE ELEMENTS

Figure 1:
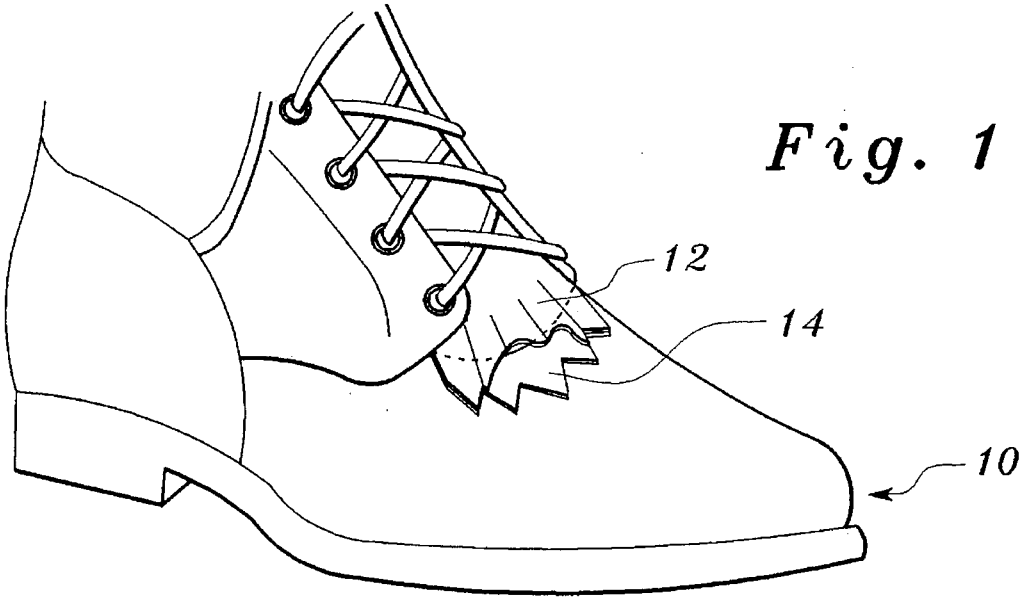
FIG. 1 is a perspective view of a boot with its kiltie cut away to reveal the weight beneath.

To aid in the correlation of the elements of the invention to the exemplary drawings, the following catalog of the elements is provided:

10 boot
12 kiltie
14 kiltie weight
16 serrated edge
18 lining
20 adhesive
22 peelable backing

DESCRIPTION OF THE PREFERRED EMBODIMENTS

Figure 2:
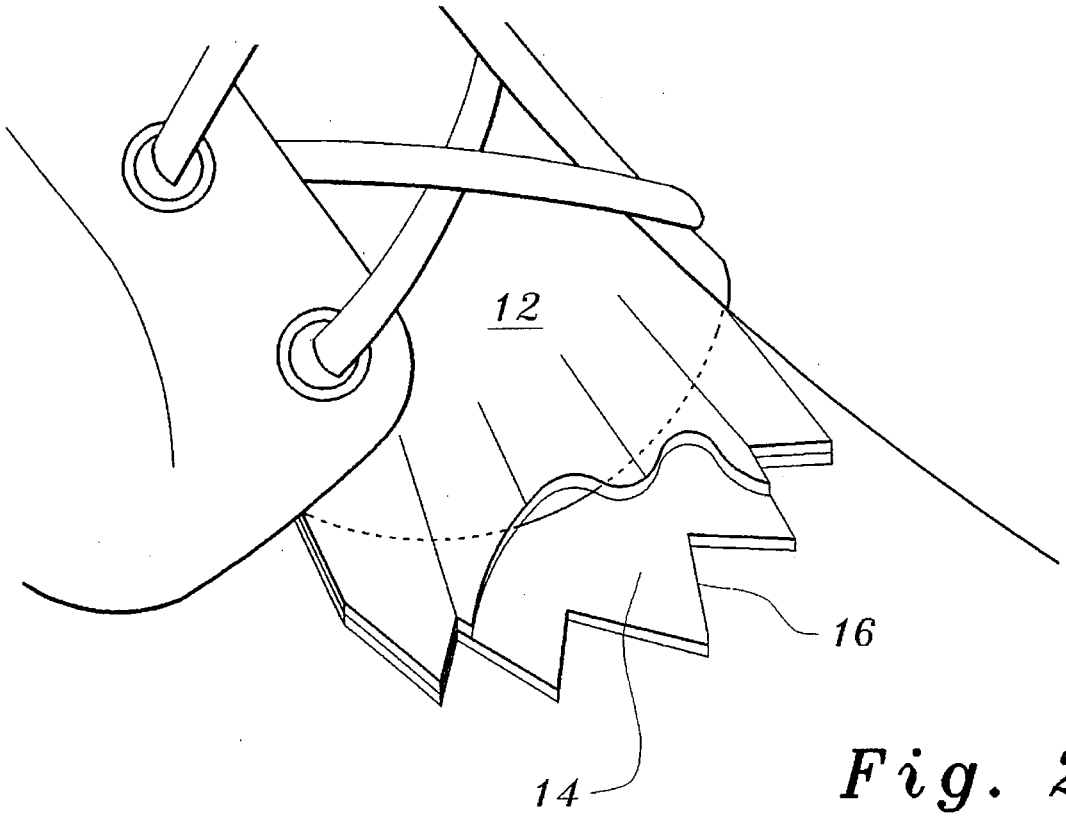
FIG. 2 is a detail of the kiltie and weight shown in FIG. 1.

The invention comprises a strip of material such as metal for attaching to the underside of a kiltie as a weight to prevent the forward edge of the kiltie from curling. Referring to the drawings, FIG. 1 shows a boot 10 having a kiltie 12 extending from the laces, over the vamp or upper of the boot. Kiltie weight 14 attaches at the forward extremity of the kiltie, on the underside where it is hidden from view. A forward edge 16 of the kiltie weight 14 is serrated, to match the serrated shape of the kiltie. For clarity of illustration, the detail of FIG. 2 shows a weight conterminous with the kiltie; it is preferred for the weight to be offset or set back slightly from the edges of the kiltie so the weight will not be visible. The forward edge 16 of the weight may also be scalloped, to match the shape of kilties with a scalloped edge.

Referring to FIG. 3, the weight 14 is made of a strip of pliable metal or of some other heavy, pliable material. The strip may be a length of thin metal plate as illustrated, or a length of wire. Where wire is used, it is bent into a serrated pattern to match the serrations on the front of the kiltie. A length of the metal strip is slightly shorter than a width of the kiltie, so that none of the strip is exposed. In one embodiment, where the weight is sold as an aftermarket attachment, the length of the strip is greater than a kiltie width; depending on the material used in the strip, the excess length may be trimmed with scissors or scored and broken off to length to match the width of the kiltie.

To prevent discoloration of the shoe vamp from contact with metal in the weight, the lower surface of the weight 14 is covered with a lining 18 or backing to prevent the metal strip from touching the shoe. The lining 18 is preferably a thin layer of leather, or alternatively is a layer of vinyl or other material, or fabric. The lining is attached to the lower surface of the weight with adhesive or by other means. As an alternative to the liner, the lower surface of the weight may be coated with a plastic material to serve the same purpose as the liner. The coating may be sprayed onto the metal, or applied by other means.

The weight may be produced as an after-market attachment for installation by the consumer, or it may be manufactured and sold as part of the kiltie. The after-market embodiment has a coating of adhesive 20 protected by a peelable backing 22 as shown in FIG. 4. To attach the weight 14 to the kiltie 12, the backing 22 is removed to expose the adhesive 20 and the weight is pressed into place against the kiltie. Alternatively, the weight has no layer of adhesive, and is attached by an adhesive applied by the consumer.

Where the weight is placed on the kiltie during manufacture, the metal weight may be attached by adhesive or other means to the kiltie leather, and then both stamped into the desired serrated shape by a die. FIG. 5 shows the successive layers of a leather kiltie 12 (uppermost), adhesive 20, metal weight 14, and lining 18 of leather or other material. The stamping method leaves the edge of the weight aligned with the edge of the kiltie, so the edge of the weight is visible. A preferred method of manufacture is to attach the weight to the kiltie in a separate step, so the weight is positioned with its edge set back slightly from the edge of the kiltie. A setback of only 1–3 mm is necessary for the edge of the weight to be hidden, so the kiltie retains its normal appearance.

In place on the kiltie, the weight of the metal strip holds the end of the kiltie against the shoe, preventing upwards curling of the kiltie. In addition, the metal strip may be bent into a curvature so that the shape of the kiltie conforms to the shape of the boot vamp. The kiltie weight may be applied to kilties on golf shoes, boots, or any other type of footwear having a kiltie.

The embodiments shown and described above are only exemplary. Various modifications can be made in the construction, material, arrangement, and operation, and still be within the scope of my invention. The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A device to prevent curling of kilties on boots and shoes, comprising:

a) a weighted strip of material for attaching to an underside of a kiltie, said strip having two ends, an upper surface, a lower surface, a front edge and a rear edge, b) said front edge of said strip being serrated to conform to a serrated shape of a front edge of a kiltie, and c) a lining on said lower surface of said strip of material.

2. The invention as described in claim 1, wherein:

d) said strip of material is a strip of pliable metal.

3. The invention as described in claim 1, wherein:

e) said strip of material is a length of wire, said wire being bent to form a serrated shape.

4. The invention as described in claim 1, wherein:

f) said lining is a layer of leather.

5. The invention as described in claim 1, wherein:

g) said lining is a layer of fabric.

6. The invention as described in claim 1, wherein h) said lining is a coating of material which will not discolor leather in contact with said material.

7. The invention as described in claim 1, further comprising:

i) means for attaching said strip of material to the underside of a kiltie.

8. The invention as described in claim 7, wherein:

j) said means for attaching said strip of material to an underside of a kiltie is a coating of adhesive on an upper surface of said strip of material.

9. The invention as described in claim 8, further comprising:

k) a removable, peelable backing to cover said coating of adhesive prior to installation of said strip of material.

10. A method to prevent curling of kilties on boots and shoes, comprising the following steps:

a) attaching a weight to an underside of a kiltie at a serrated front edge of the kiltie, and b) lining a lower surface of said weight with material to prevent discoloration of leather in contact with said weight.

11. The method as described in claim 10, the step of attaching a weight further comprising:

c) attaching a strip of malleable metal having a serrated front edge to an underside of a kiltie at a serrated front edge of the kiltie.

12. The method as described in claim 10, the step of attaching a strip of malleable metal further comprising:

d) attaching with adhesive a strip of malleable metal having a serrated front edge to an underside of a kiltie at a serrated front edge of the kiltie.

13. The method as described in claim 10, the step of lining a lower surface of said weight further comprising:

e) coating a lower surface of said weight to prevent said weight from contacting shoe leather beneath said weight.

14. The method as described in claim 10, the step of lining a lower surface of said weight further comprising:

f) lining a lower surface of said weight with a layer of leather.

* * * * *